United States Patent [19]

Chiman

[11] Patent Number: 4,998,833

[45] Date of Patent: Mar. 12, 1991

[54] REFILLABLE INK RIBBON CARTRIDGE FOR USE IN AN ELECTRONIC TYPEWRITER

[76] Inventor: Hwang Chiman, 28606 Pacific Hwy. So. 65, Federal Way, Wash. 98003

[21] Appl. No.: 466,584

[22] Filed: Jan. 17, 1990

[51] Int. Cl.[5] ..... B41J 32/00

[52] U.S. Cl. ..... 400/208; 400/242

[58] Field of Search ..... 400/207, 208, 208.1, 400/194, 195, 196, 196.1, 197, 198, 199, 200–202.4, 248, 248.1, 250, 242; 242/197

[56] References Cited

U.S. PATENT DOCUMENTS

| | | | |
|---|---|---|---|
| 3,464,533 | 2/1969 | Gallant | 400/248 |
| 3,664,603 | 5/1972 | Eskay | 242/197 |
| 3,849,797 | 11/1974 | Camras | 242/197 |
| 3,869,099 | 5/1975 | Inaga | 242/199 |
| 3,937,325 | 2/1976 | Dodge et al. | 242/197 |
| 4,032,985 | 6/1977 | Camras | 242/197 |
| 4,234,137 | 11/1980 | Watanabe | 242/71.8 |
| 4,329,073 | 5/1982 | Craft | 400/208 |
| 4,367,052 | 1/1983 | Steger | 400/208 |
| 4,367,963 | 1/1983 | Daughters | 400/208 |
| 4,406,553 | 9/1983 | Nally et al. | 400/208 |
| 4,472,074 | 9/1984 | Gabler | 400/207 |
| 4,473,198 | 9/1984 | Pertzsch | 242/197 |
| 4,505,605 | 3/1985 | Hasegawa | 400/208 |
| 4,609,298 | 9/1986 | Shioda | 400/208 |
| 4,650,357 | 5/1987 | Sidvers | 400/208 |
| 4,655,623 | 4/1987 | Gasser | 400/208 |
| 4,830,524 | 5/1989 | Shore | 400/248 |
| 4,861,177 | 8/1989 | Heins | 400/250 |

FOREIGN PATENT DOCUMENTS

| | | | |
|---|---|---|---|
| 3401206 | 4/1985 | Fed. Rep. of Germany | 400/208 |
| 3625089 | 4/1987 | Fed. Rep. of Germany | 400/208 |
| 144067 | 6/1988 | Japan | 400/208 |
| 2126192 | 4/1984 | United Kingdom | 242/197 |

*Primary Examiner*—David A. Wiecking
*Assistant Examiner*—Joseph R. Keating
*Attorney, Agent, or Firm*—Birch, Stewart, Kolasch & Birch

[57] ABSTRACT

A refillable ink ribbon cartridge for use in an electronic typewriter which includes a housing, a changeable feed spool member having a semi-global member for slidably inserting into and removing from an aperture of a tensible plate supported on the cartridge through one side opening, a winding spool member having a semi-global head engagement for converting into the feed spool member, a spring arm for easily removing the winding spool member from the cartridge through the other side opening of the cartridge, and a plurality of stoppers for easily controlling the tensibility of winding spool spring, and a jagged wheel, whereby the used ink ribbon cartridge can be reused and maintains a constant tension on an ink ribbon between the feed and winding spools.

13 Claims, 10 Drawing Sheets

REFILLABLE INK RIBBON CARTRIDGE FOR USE IN AN ELECTRONIC TYPEWRITER

BACKGROUND OF THE INVENTION

1. Field of the Invention

The present invention relates to a refillable ink ribbon cartridge for use in an electronic typewriter or a printer and more particularly, to an ink ribbon cartridge for use in an electronic typewriter which includes a changeable feed spool replaced through one side opening and a winding spool about which is wound a used ribbon which is taken out of the cartridge by operation of a spring arm through the other side opening of the cartridge wherein the winding spool can be easily converted to the supply spool, whereby the used cartridge can be reused without creating waste materials.

2. Description of the Prior Art

Various types of disposal ink ribbon cartridges are well known in the art. For example, in such disposal ink ribbon cartridges, the feed spool and the winding spool are operatively maintained the resilience of an ink ribbon by a feed spool spring as described in U.S. Pat. No. 4,406,554 to Nally et al and U.S. Pat. No. 4,655,623 to Gasser. However, such ink ribbon cartridges are incapable of allowing replacement of the feed spool and have to be thrown away with the used ribbon after one use so as to create large amounts of waste materials. Furthermore, such ribbon cartridges do not disclose the use of a winding spool to be easily converted to a supply spool

SUMMARY OF THE INVENTION

Accordingly, it is an object of the present invention to provide a refillable ink ribbon cartridge for use in an electronic typewriter.

Another object of the present invention is to provide an ink ribbon cartridge which includes a changeable feed spool replaced through one side opening and a winding spool about which is wound a used ribbon which may be removed therefrom by operation of a spring arm through the other side opening of the cartridge.

A further object of the present invention is to provide a refillable ribbon cartridge which includes a feed spool member having a semi-global member for slidably inserting into and removing from an aperture of a tensible plate supported on the cartridge, and a winding spool member having a semi-global engagement for converting into the feed spool member whereby the feed spool and winding spool members can be reused.

Still another object of the present invention is to provide a refillable ink ribbon cartridge for use in an electronic typewriter which includes a winding spool member having a winding spool spring and a plurality of stoppers for easily controlling the tensibility of the winding spool spring.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a refillable ink ribbon cartridge for use in an electronic typewriter which includes a housing, a changeable feed spool member having a semi-global member for slidably inserting into and removing from an aperture of a tensible plate supported on the cartridge through one side opening, a winding spool member having a semi-global head engagement for converting into the feed spool member, a spring arm for easily removing the winding spool member from the cartridge through the other side opening of the cartridge, and a plurality of stoppers for easily controlling the tensibility of winding spool spring, and a jagged wheel, whereby the used ink ribbon cartridge can be reused and maintains a constant tension on an ink ribbon between the feed and winding spools.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
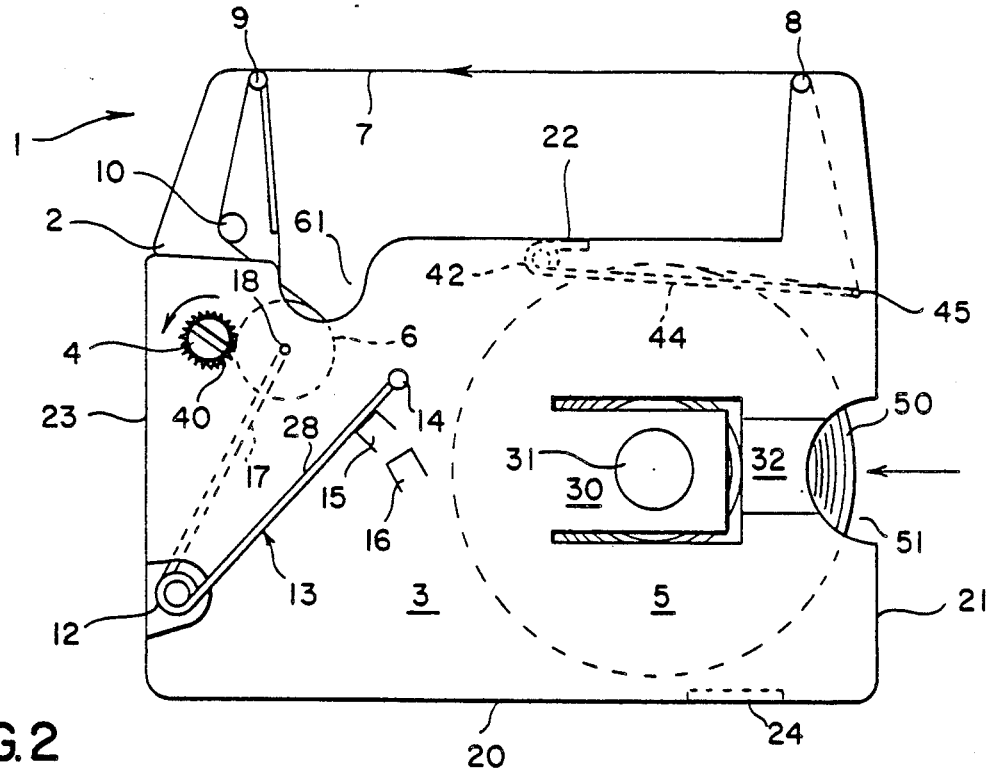
FIG. 1 is a top plan view of a refillable ink ribbon cartridge in accordance with the present invention.

Referring now in detail to the drawings for the purpose of illustrating preferred embodiments of the present invention, the refillable ink ribbon cartridge 1 as shown in FIGS. 1–4 comprises a housing including a casing base 2, a casing top cover 3, a C-shaped rear wall 22, a feed spool side opening 21, a winding spool side wall 23, a front side wall 24 having a front side opening 20, a feed spool member including a feed spool 5, a winding spool member including a winding spool 6 disposed within the housing, and a drive roller 4 in the vicinity of the winding spool 6. The casing top cover 3 includes a feed spool guide channel 32 and a feed spool holding plate 30 having a hole 27 for receiving a semi-global member 31 of the feed spool 5 in the ribbon cartridge 1 through the feed spool guide channel 32 (FIG. 2) and a hook 45 of one end of a pivotal spring 44. Also, guide pins 8, 9, and 10 are supported on the casing base 2, for passing an ink ribbon 7 therethrough from the feed spool 5 to the winding spool 6. The C-shaped rear wall 22 is provided with a winding spool gulf 61 in the vicinity of the winding spool 6 for easily connecting the ink ribbon 7 to the winding spool 6 by the use of a finger.

The feed spool side opening 21 is disposed on the feed spool side of the ribbon cartridge 1 for easily inserting and removing the feed spool 5 into and from the ribbon cartridge 1. The feed spool side opening 21 has a gulf 51 for easily inserting the feed spool 5 having a brand-new ribbon 50 into the ribbon cartridge 1.

Figure 2:
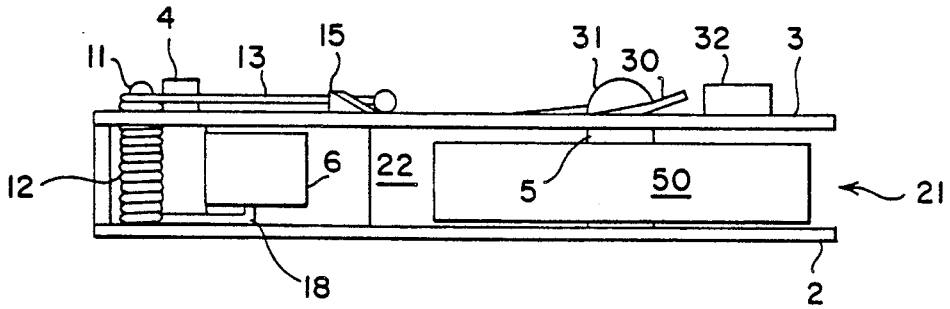
FIG. 2 is a front elevational view of FIG. 1.
Figure 3:
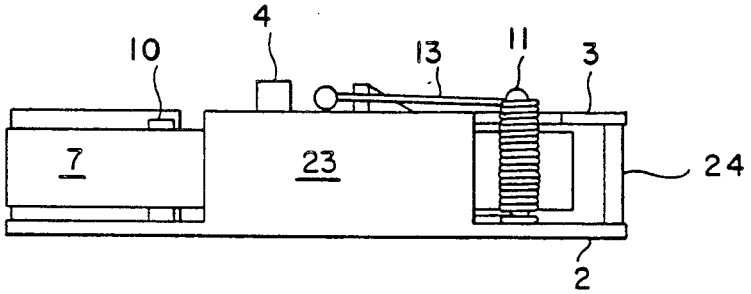
FIG. 3 is a left side elevational view of FIG. 1.
Figure 4:
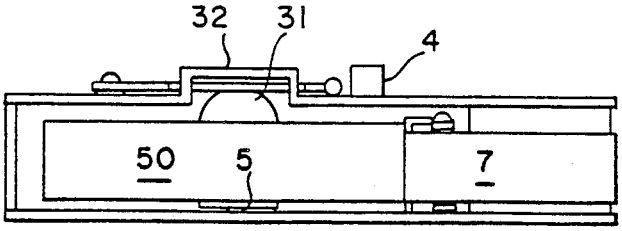
FIG. 4 is a right side elevational view of FIG. 1.
Figure 5:
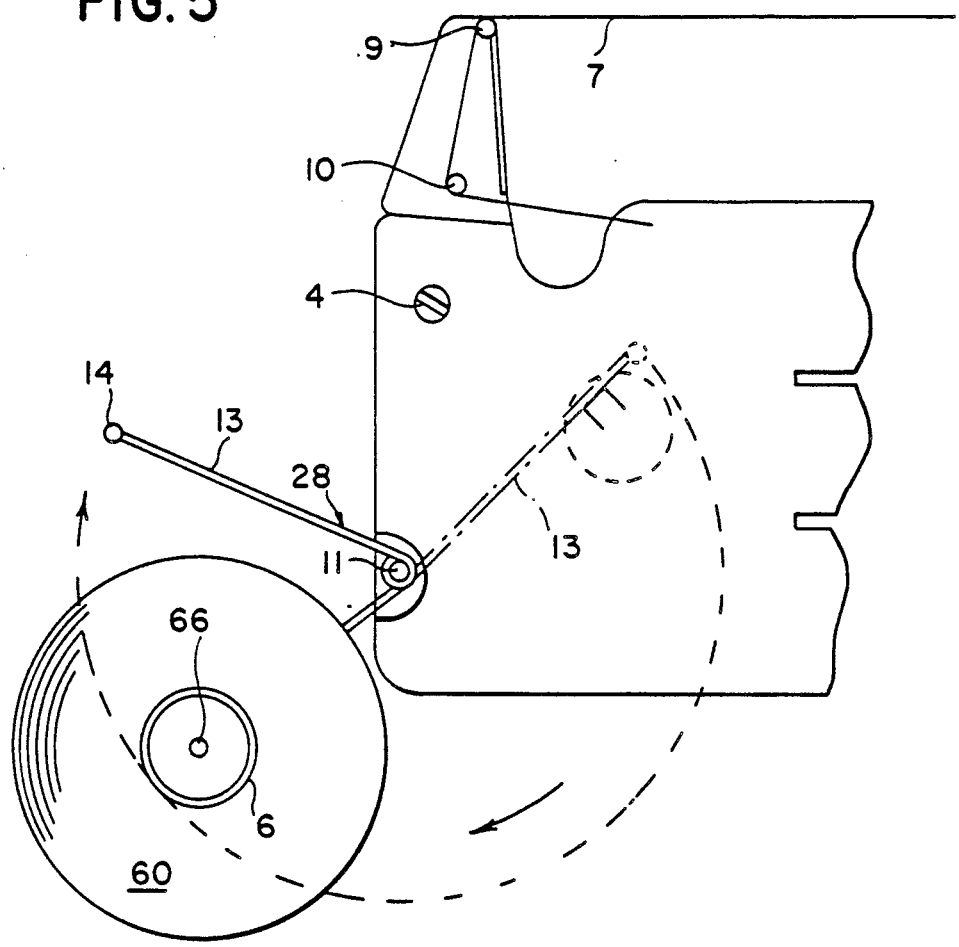
FIG. 5 is a top plan view illustrating how to remove the used ribbon in accordance with the present invention.
Figure 6:
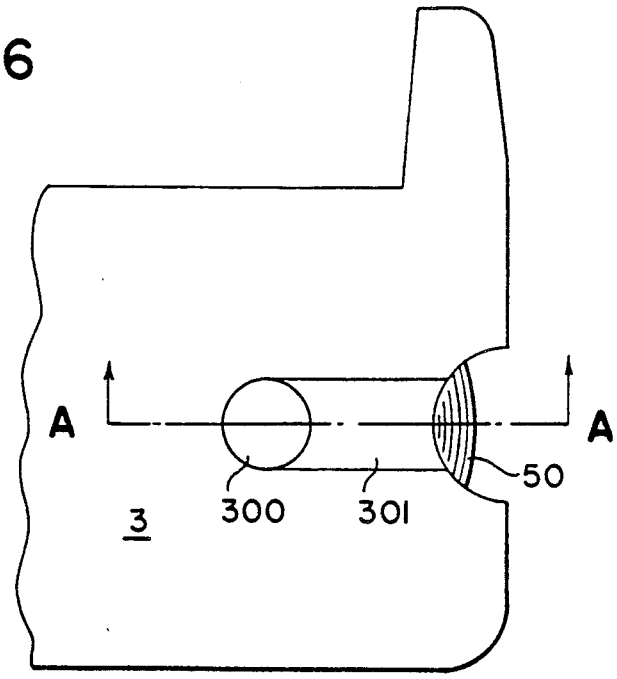
FIG. 6 is a top plan view illustrating another embodiment of a feed spool member in accordance with the present invention.
Figure 7:
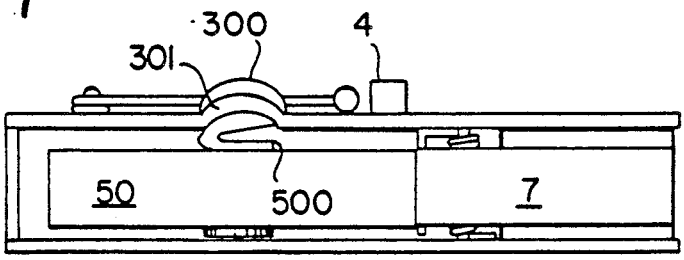
FIG. 7 is a right side elevational view of FIG. 6.
Figure 8:
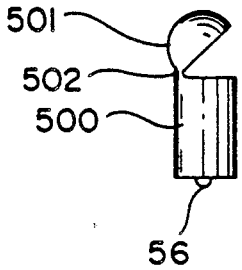
FIG. 8 is a front elevational view of a hub having a semi-global member of a feed spool in FIG. 7.
Figure 9:
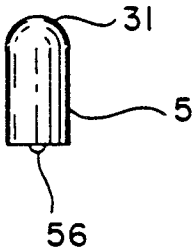
FIG. 9 is a front elevational view of a hub having a semi-global member of a feed spool in FIG. 2.

As shown in FIGS. 2 and 5, a V-shaped winding spool spring 13 pivotably connected to a fixed pin 11 through a pivotal spring ring 12 disposed at the center thereof. The V-shaped winding spool spring 13 is provided with a lever 28, a lever engagement 14, an arm 17, and a spring arm shaft 18 at the one end thereof for slidably receiving the winding spool 6 through a hub 66 of the winding spool 6 and the lever engagement 14 at the other end thereof for readily engaging a plurality of stoppers 15 and 16 disposed on the outside surface of the casing top cover 3 of the ribbon cartridge 1 (FIG. 1).

The drive roller 4 has a jagged wheel 40 for resisting the used ribbon 60 of the winding spool 6 and maintaining a constant tension on the ink ribbon 60 between the feed spool 5 and the winding spool 6 so that the ribbon 7 from the feed spool 5 has a substantially constant resilient force (FIG. Thus, the stoppers 15 and 16 alternatively give a constant biasing force to the hub 66 of the winding spool 6 for tight positioning against the jagged wheel 40 of the drive roller 4. For example, the lever engagement 14 of the V-shaped winding spool spring 13 is positioned in the stopper 15, the biasing force to the hub 66 of the winding spool 6 is stronger than that when the lever engagement 14 is positioned in the stopper 16. The V-shaped winding spool spring 13 defines an angle of 30° to 45° therebetween (FIGS. 1 and 5).

As shown in FIGS. 1 and 5, the fixed pin 11 supported on the casing base 2 receives the pivotal spring ring 12 of the V-shaped winding spool spring 13. The lever 28 of the V-shaped winding spool spring 13 for locking with the lever engagement 14 thereof is moved in the direction indicated by an arrow from the open position shown in FIG. 5 by releasing the lever 28 from the stoppers 15 and 16 to the closed position as shown in FIG. 1.

Figure 10:
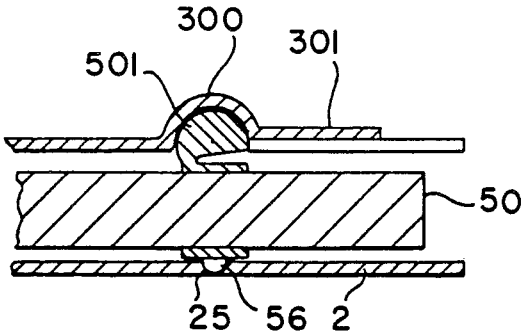
FIG. 10 is a cross-sectional view of the cartridge of FIG. 6, taken along line A—A.

Referring in detail to FIGS. 6, 7, 8, 9, and 10, there is illustrated another embodiment of an ink ribbon cartridge 1 according to the present invention. Instead of the semi-global member 31 having a raised position 56 of the feed spool 5 of FIGS. 1 and 9, a head 501 and a tensible neck 502 of a feed spool 500 having the raised portion 56 thereof maintain the position of the feed spool 5 for slidably inserting the feed spool 500 into a head receiver 300 through a guide road 301 disposed on the casing top cover 3. At this time, the raised portion 56 inserts into a slot 25 disposed in the casing base 2 (FIG. 10).

Figure 11:
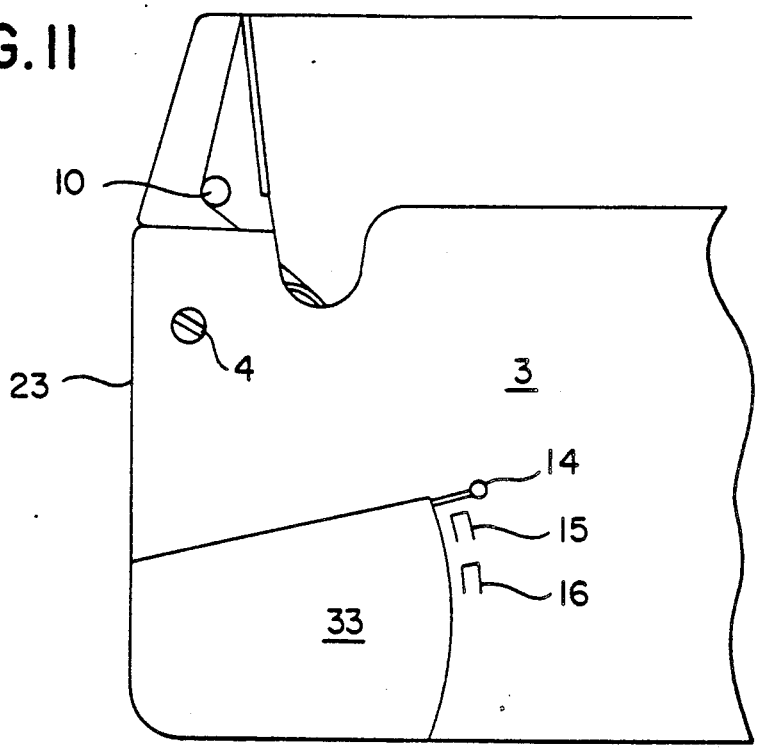
FIG. 11 is a top plan view of another additional embodiment of a winding spool member.
Figure 12:
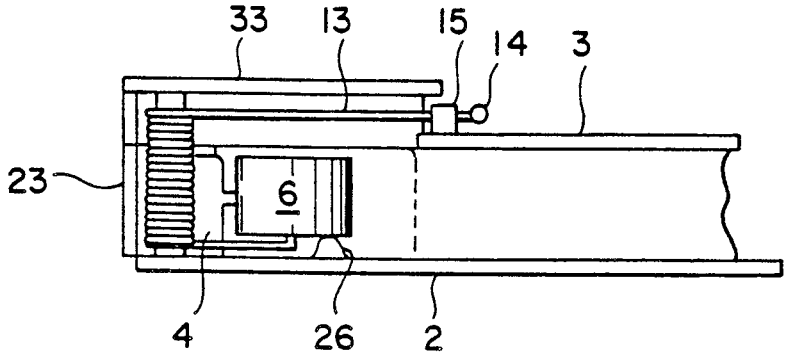
FIG. 12 is a front elevational view of FIG. 11.
Figure 13:
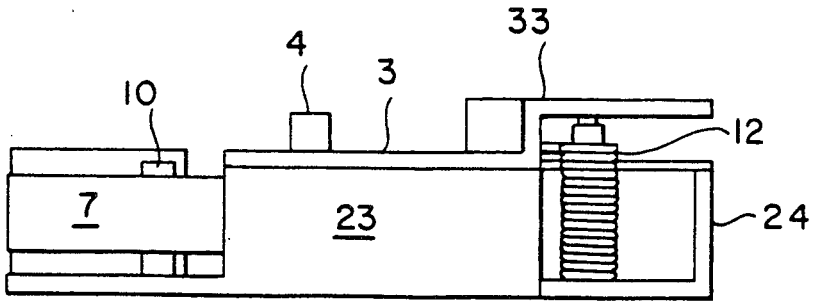
FIG. 13 is a left side elevational view of FIG. 11.

Referring in detail to FIGS. 11, 12, and 13, there is illustrated a further embodiment of an ink ribbon cartridge 1 according to the present invention. The lever 28 of the V-shaped winding spool spring 13 is disposed within a spring housing 33 which duplicates on the casing top cover 3 for horizontally moving the lever 28 between the casing top cover 3 and spring housing 33.

Figure 14:
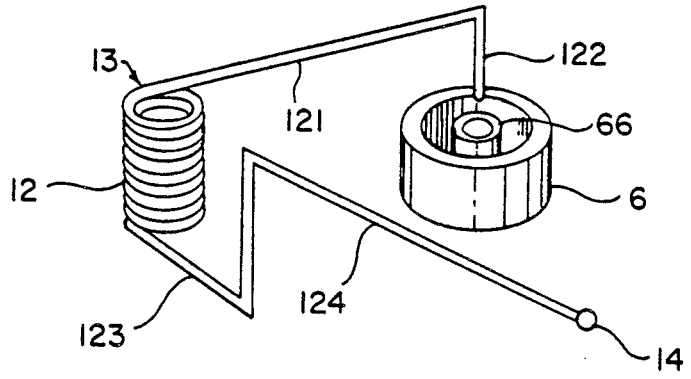
FIG. 14 is a perspective view illustrating another embodiment of a winding spool spring with the winding spool in accordance with the present invention.
Figure 15:
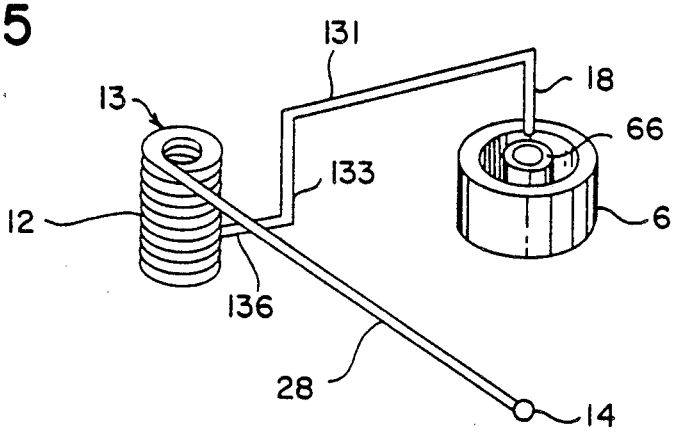
FIG. 15 is a perspective view of a further embodiment of the winding spool spring with the winding spool.
Figure 16:
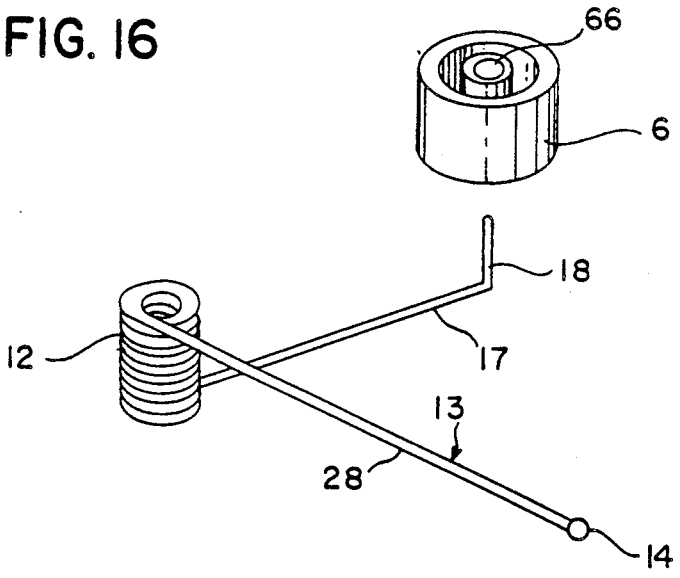
FIG. 16 is an enlarged perspective view of the winding spool spring with the winding spool of FIG. 1.

Referring in detail to FIGS. 14 and 15, there are illustrated an additional embodiment of the winding spool member of the ink ribbon cartridge 1 according to the present invention. In the ink ribbon cartridge 1 of FIGS. 1 and 16, instead of the V-shaped winding spool spring 13, first of all, the V-shaped winding spool spring 13 turns over, that is, an arm 121 and a spring arm shaft 122 maintain the position of the arm 17 and the spring arm shaft 18. Second, bending levers 123 and 124 maintain the position of the lever 13 (FIG. 14). In FIG. 15, instead of the L-shaped arm 17 of FIGS. I and 6, bending arms 131, 133, and 136 maintain the position of the lever 28.

Figure 17:
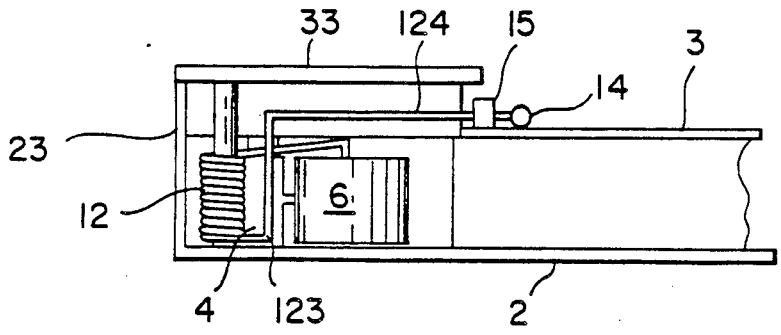
FIG. 17 is a front elevational view of FIG. 11.

FIG. 17 is a perspective view illustrating another embodiment of the winding spool spring 13 (FIG. 14) in the application of the winding spool 6 in accordance with the present invention.

Figure 19:
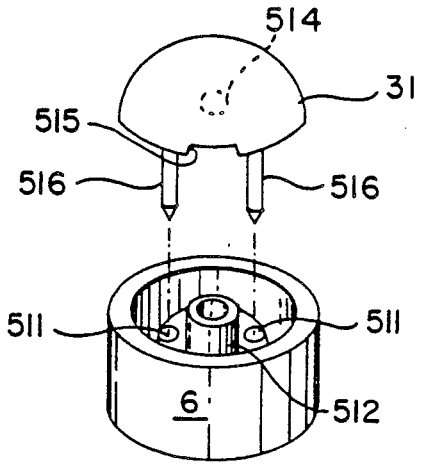
FIG. 19 is an exploded perspective view of the winding spool having a semi-global member to be converted into the feed spool in accordance with the present invention.
Figure 20:
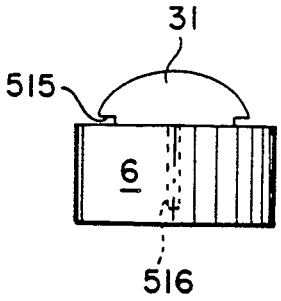
FIG. 20 is a front elevational view of the winding spool having the semi-global member.

As shown in FIGS. 19 and 20, the winding spool 6 is provided a center pin 512 and a plurality of engagements 511 for mating with a plurality of pins 516 and a center pin receptacle 514 of the semi-global member 31. Therefore, by assembling the semi-global member 31 with the winding spool 6 (FIG. 19), the winding spool 6 can be easily converted to the feed spool 5 (FIG. 20). The semi-global member 31 has a plurality of slots 515, thereby separating the semi-global member 31 from the spool 6.

Figure 18A:
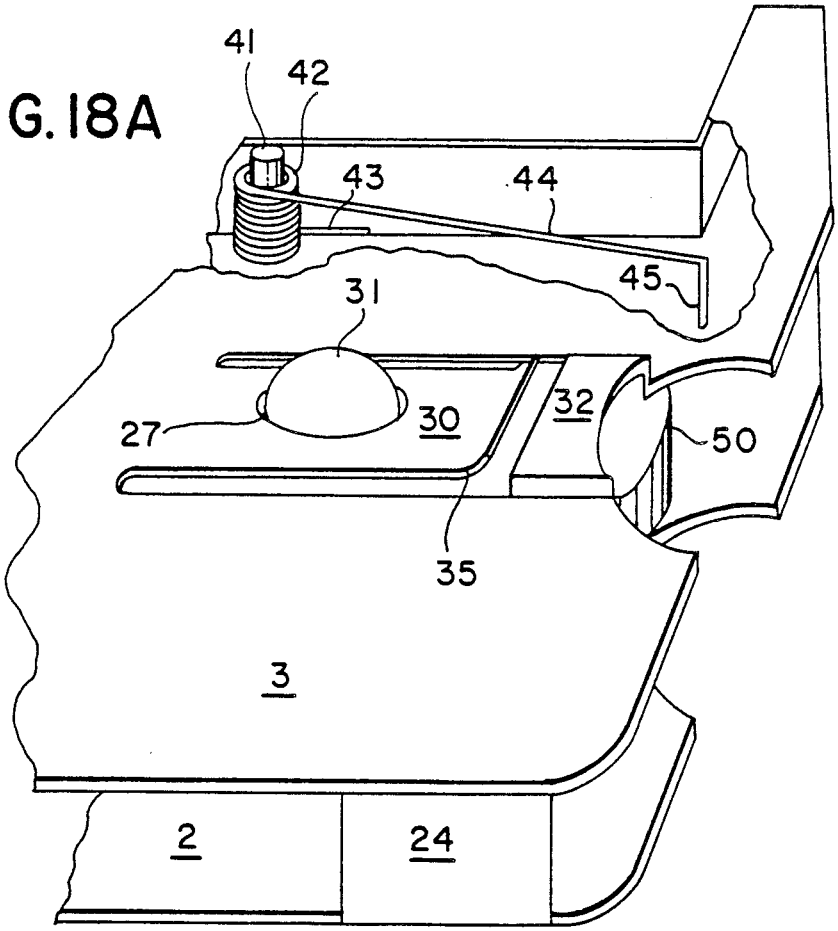
FIG. 18A is a perspective view of the cartridge in accordance with the present invention containing cutaway portions in order to illustrate the construction of a tension spring and the feed spool.

As shown in FIG. 18A, the ink ribbon 50 has to pass a spring end 45 of a pivotal spring 44 having a spring ring 42 about a fixing pin 41 supported on the casing base 2.

Figure 18B:
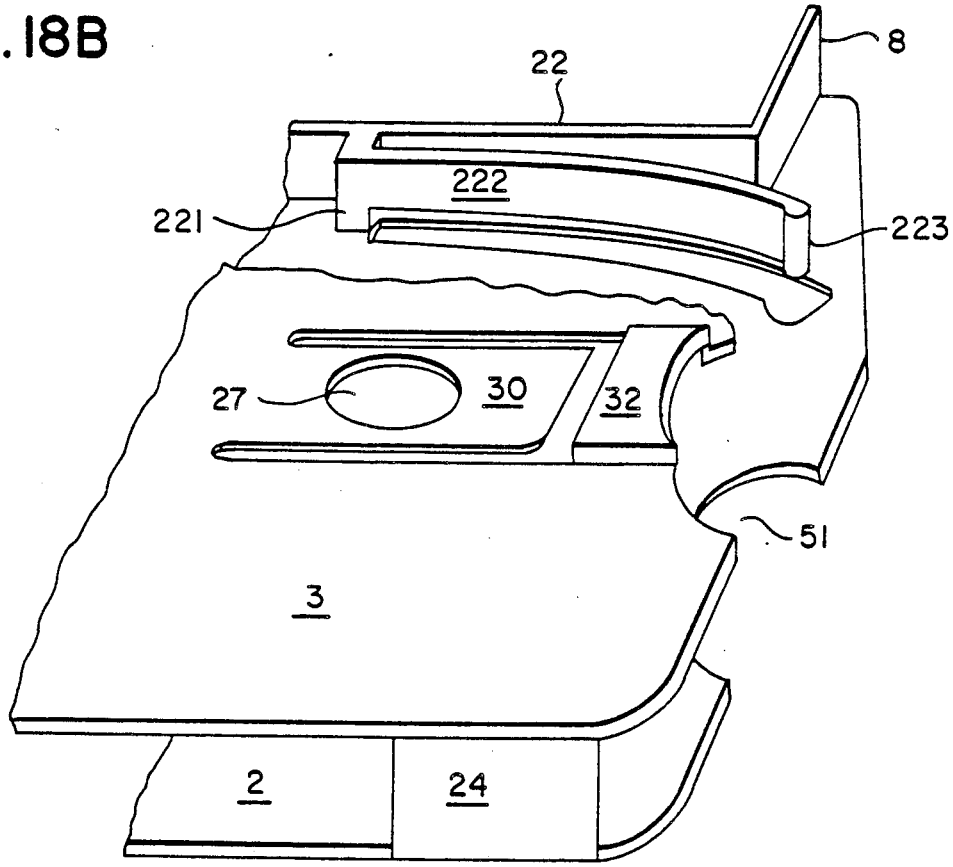
FIG. 18B is a perspective view of the cartridge in accordance with the present invention containing cutaway portions in order to illustrate the construction of a plastic plate spring.

FIG. 18B is a perspective view illustrating another embodiment of the pivotal spring 44 according to the present invention. Instead of the pivotal spring 44, a plastic plate spring 222 maintain the position of the pivotal spring 44 and the plastic plate spring 222 having a spring end 223 is attached to the C-shaped wall 22 at the other end thereof.

Figure 21:
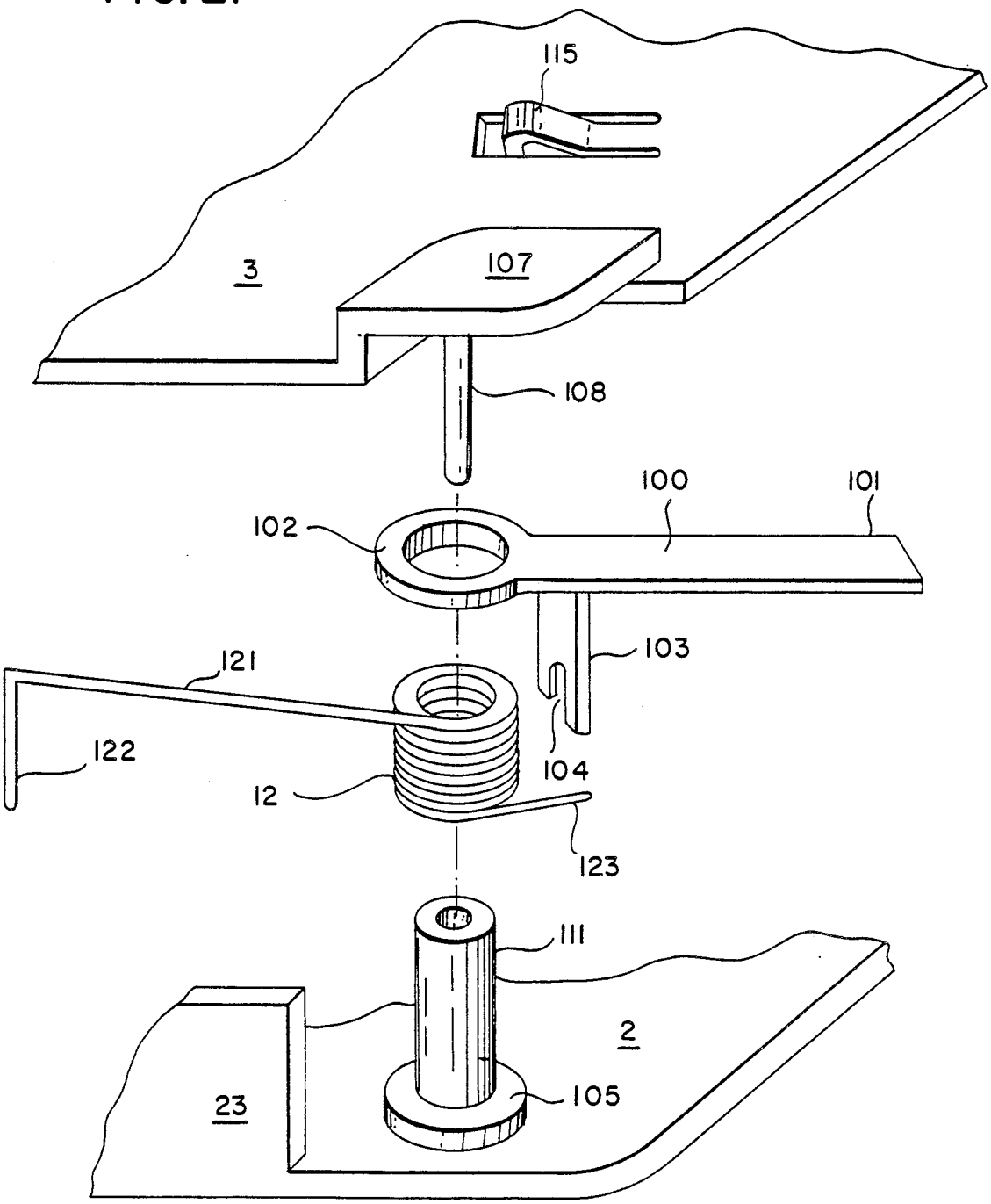
FIG. 21 is an exploded perspective view of still another embodiment of the winding spool spring according to the present invention.

FIG. 21 is an exploded perspective view of still another embodiment of the winding spool spring 13 according to the present invention. Instead of the V-shaped spring 13 of FIG. 14, the V-shaped spring 13 is provided with a T-shaped lever 100 including a ring 102 and a handle 101 disposed both horizontal ends and a slot 104 disposed a vertical end thereof, a lever cover 107, and a tensible stopper 115. Therefore, the V-shaped winding spool spring 13 is pivotally fixed with a tubular fixing pin 11 through the spring ring 12 thereof and then the spring end 123 is engaged with the slot 104. The lever cover 107 extends a pin 108 for slidably inserting the lever ring 102, the spring ring 12, and the tubular fixing pin 111 so that the T-shaped lever 100 can be locked to the tensible stopper 115. Accordingly, when the lever handle 101 is released from the tensible stopper 115, the winding spool 6 can be readily taken out from the ink ribbon cartridge 1.

Figure 22:
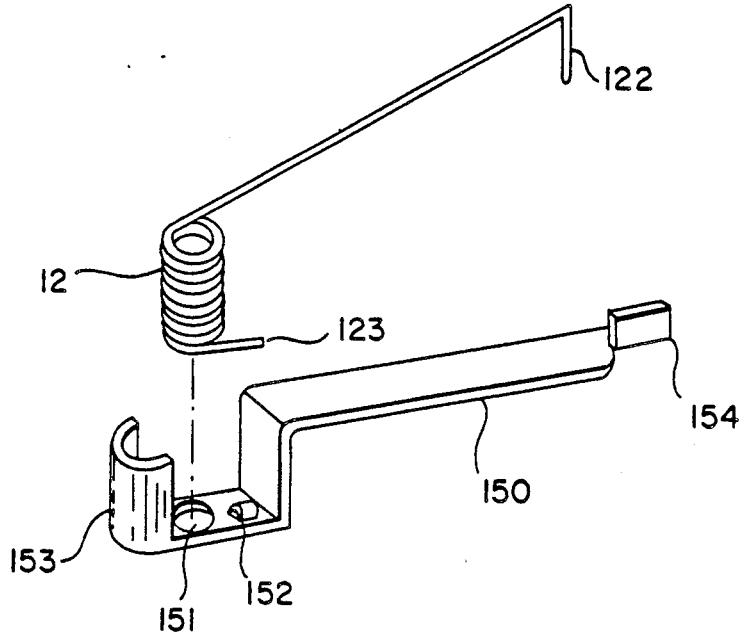
FIG. 22 is an exploded perspective view of yet another embodiment of the winding spool spring according to the present invention.

FIG. 22 is an exploded perspective view of yet another embodiment of the winding spool spring 13 according to the present invention. Instead of the T-shaped lever 100 of FIG. 21, a C-shaped end lever 150 maintain the position of the lever 100 and the C-shaped end lever 150 includes a C-shaped end downwardly disposed at one end and a lever handle 154 disposed at the other end thereof. The C-shaped end contains a semi-cylindrical wall 153 for receiving the spring ring 12 and an engagement 152 for tightly receiving the spring end 123. Therefore, the lever handle 154 can be locked to and released from the tensible stopper 115 (FIG. 22).

Figure 23:
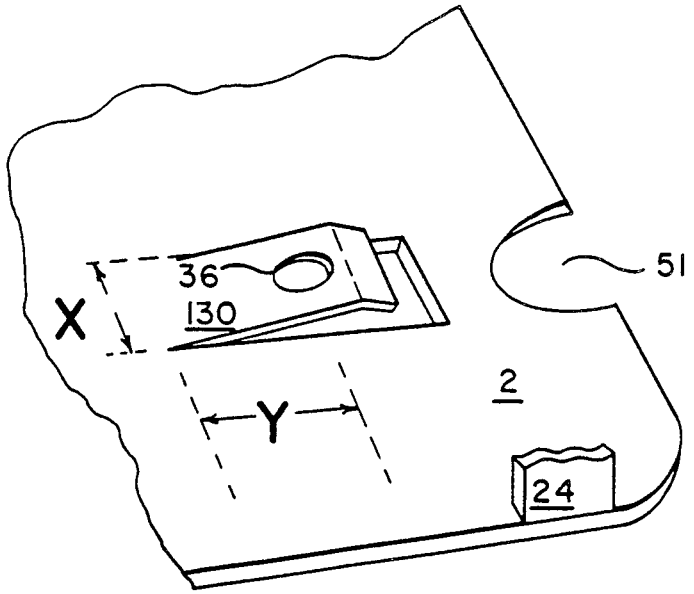
FIG. 23 is a perspective view of another embodiment of the feed spool holding plate according to the present invention.

As shown in FIG. 23, the casing base 2 is provided with a tensible feed spool holding plate 130 having a hole 36 disposed in the center thereof supported on the casing base 2 for slidably receiving the semi-global member 31 of the feed spool 5 through the gulf 51. At this time, the resilient force of the tensible feed spool holding plate 130 is proportioned to the width (X) and length (Y) of the tensible feed spool holding plate 130.

Figure 24:
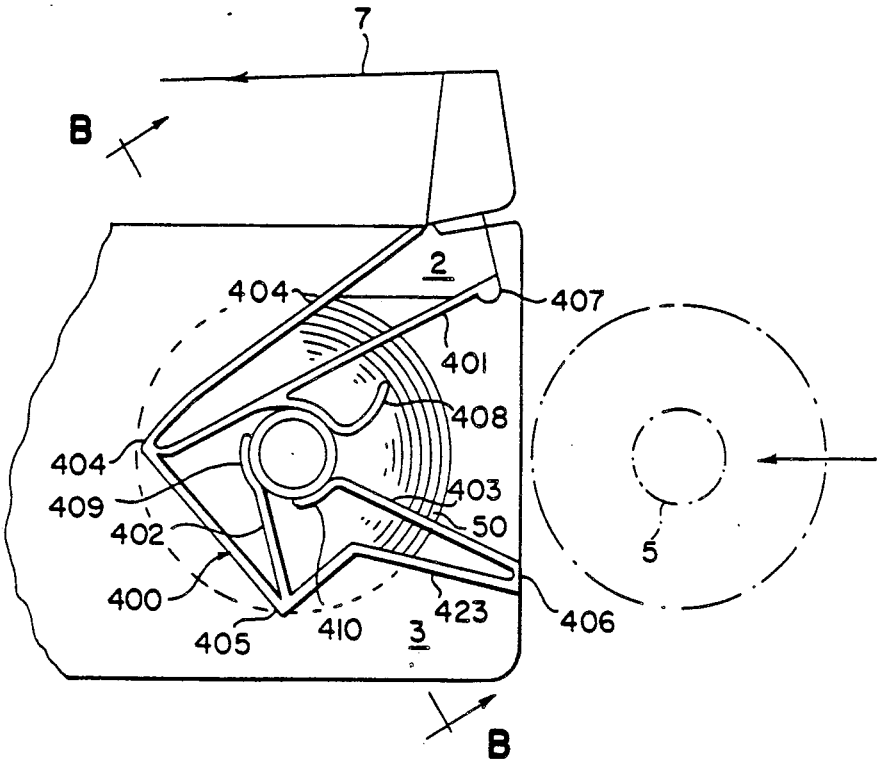
FIG. 24 is a top plan view of a further embodiment of the feed spool holding arm according to the present invention.
Figure 25:
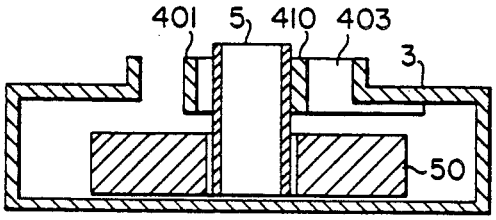
FIG. 25 is a cross-sectional view of FIG. 24, taken along line B—B.
Figure 26:
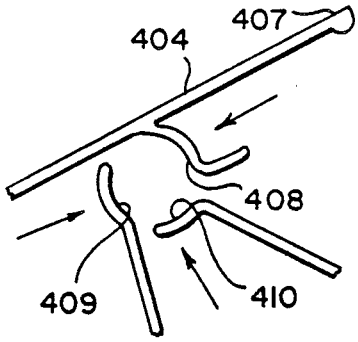
FIG. 26 diagrammatically shows the direction of force of a feed spool holding arm of FIG. 24.

FIGS. 24, 25, and 26 illustrate a further embodiment of a feed spool holding arm 400 according to the present invention. The feed spool holding arm 400 has a U-shaped configuration. A first leg 401, a second leg 402, and a third leg 403 are extended from a first bending point 404, a second bending point 409, and one end 406, respectively. The first leg 401 includes a round end 407 for easily passing the ink ribbon 50 therethrough and an outwardly bending branch 408 for guiding the feed spool 5. The second and third legs 402 and 403 includes circular ends for slidably receiving the feed spool 5, respectively. Thus, the feed spool 5 can be tightly retained by the bending branch 408 and the circular ends 409 and 410 of the first, second, and third legs 401, 402, and 403.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A refillable ink ribbon cartridge for use in an electric typewriter and a printer, which comprises:

a case housing including a casing base, a casing top cover, a rear wall, a feed spool side wall having a feed spool side opening, and a front side wall having a front side opening, a changeable feed spool engaged within said case housing, said changeable feed spool having a hub and provided with a feed spool holding plate having a center hole and a feed spool guide channel disposed on the top surface of said case housing, respectively, for being located in parallel, a semi-global member assembled with said hub of said feed spool for slidably inserting in the center hole of said feed spool holding plate, said semi-global member being provided with a plurality of legs and a center and pin receptacle further provided with a plurality of slots disposed in the bottom thereof, an ink ribbon, a replaceable winding spool engaged within said case housing in the vicinity of said changeable feed spool for winding the ink ribbon received from said feed spool, said replaceable winding spool provided with a fixed pin supported on said casing base and a V-shaped pivotal connecting spring about said fixed pin defining a pair of arms for connecting to a hub of the winding spool through one of said arms, and a plurality of apertures and a center leg disposed therein for mating with the plurality of legs and the center pin receptacle of the semi-global member so as to convert the winding spool to the feed spool, a lever being the other of said arms and disposed on the top surface of said case housing, a plurality of stoppers disposed on the top surface of said casing house for locking and releasing said lever, means for transferring the ink ribbon from said feed spool to said winding spool, and a drive roller having a jagged wheel disposed within said case housing and in the vicinity of said winding spool for maintaining tension on the ink ribbon on the winding spool, whereby the feed spool inserted into and removed from the ribbon cartridge through the feed spool side opening and the winding spool can be replaced after removal of the used ink ribbon wound about the winding spool so that the used cartridge can be reused and maintains a certain tension on the ink ribbon between the feed spool and winding spool.

2. The refillable ink ribbon cartridge of claim 1, wherein the rear wall has a C-shaped configuration.

3. The refillable ink ribbon cartridge of claim 2, wherein the plurality of legs are provided with circular ends thereof for tightly connecting a plurality of apertures to the hub of the feed spool.

4. The refillable ink ribbon cartridge of claim 1, wherein a plurality of gulfs are disposed on said case housing and in vicinity of said feed spool and said winding spool, respectively, for easily handling the feed spool and the winding spool.

5. The refillable ink ribbon cartridge of claim 1, wherein the V-shaped pivotal connecting spring having a spring ring disposed at the center portion thereof two defines bending arms for providing a strong resilient force to said arms.

6. The refillable ink ribbon cartridge of claim 5, wherein the V-shaped pivotal connecting spring is provided with the lever which is one of both bending arms thereof.

7. The refillable ink ribbon cartridge of claim 1, wherein the V-shaped pivotal connecting spring having a spring ring is provided with a T-shaped lever having a ring end and a slot end for receiving a lever cover pin mounted to a lever cover and one end connecting spring of the V-shaped pivotal connecting spring, respectively, whereby the T-shaped lever can be locked to and released from a tensible stopper disposed on the top surface of the case housing.

8. The refillable ink ribbon cartridge of claim 7, wherein the spring ring of the V-shaped pivotal connecting spring is engaged with a tubular pin supported on the inside of the casing base of the case housing for slidably receiving the lever cover pin mounted to the lever cover.

9. The refillable ink ribbon cartridge of claim 7, wherein the spring ring of the V-shaped pivotal connecting spring is provided with a locking lever and is engaged with a semi-circular wall container extended from said locking lever for tightly containing said spring ring, said semi-circular wall container having an engagement for fixing one end of the V-shaped pivotal connecting spring.

10. The refillable ink ribbon cartridge of claim 1, wherein the lever is provided with a separate lever cover disposed on the top surface of the casing top cover so that the lever slidably moves between the separate lever cover and the casing top cover.

11. The refillable ink ribbon cartridge of claim 13, wherein the semi-global member is provided with a tensible neck for slidably inserting into a semi-global receiver disposed on the feed spool holding plate.

12. The refillable ink ribbon cartridge of claim 1, wherein the transferring means includes a hook formed at one end of a pivotal spring, and a plurality of pins supported on said casing base for tightly moving from the feed spool to the winding spool.

13. The refillable ink ribbon cartridge of claim 12, wherein the pivotal spring is substituted for a plastic plate spring wherein one end of the plastic plate spring can be passed the ink ribbon from the feed spool therethrough.

* * * * *